US008262056B2

(12) United States Patent
Schwoerer

(10) Patent No.: US 8,262,056 B2
(45) Date of Patent: Sep. 11, 2012

(54) PROP HEAD FOR CEILING FORMWORK

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 561 days.

(21) Appl. No.: 12/312,581

(22) PCT Filed: Nov. 15, 2007

(86) PCT No.: PCT/DE2007/002066

§ 371 (c)(1),
(2), (4) Date: May 18, 2009

(87) PCT Pub. No.: WO2008/061501

PCT Pub. Date: May 29, 2008

(65) Prior Publication Data

US 2010/0044548 A1 Feb. 25, 2010

(30) Foreign Application Priority Data

Nov. 23, 2006 (DE) ..... 10 2006 055 306

(51) Int. Cl.
*E04G 17/00* (2006.01)
*E04G 11/38* (2006.01)
*E04G 25/00* (2006.01)

(52) U.S. Cl. ..... 249/210; 249/18; 248/357

(58) Field of Classification Search ..... 249/18, 249/24, 26, 28, 210; 254/101, DIG. 4; 248/122.1, 248/200.1, 235, 351, 357, 178.1, 185.1; 108/6, 108/7, 8, 155
See application file for complete search history.

(56) References Cited

U.S. PATENT DOCUMENTS

| | | | | | |
|---|---|---|---|---|---|
| 867,531 | A | * | 10/1907 | Potter | 254/101 |
| 886,956 | A | * | 5/1908 | De France et al. | 254/101 |
| 1,907,877 | A | * | 5/1933 | Roos | 249/193 |
| 2,532,168 | A | * | 11/1950 | Jakoubek | 254/101 |
| 3,239,188 | A | | 3/1966 | Gostling | |
| 3,430,910 | A | * | 3/1969 | Bowden et al. | 254/100 |
| 3,535,071 | A | * | 10/1970 | Bore | 248/357 |
| 3,606,232 | A | * | 9/1971 | Young | 248/357 |
| 3,647,173 | A | * | 3/1972 | Pipala | 249/31 |
| 3,861,634 | A | * | 1/1975 | Hood et al. | 248/228.3 |
| 3,915,423 | A | | 10/1975 | Tooley | |
| 4,095,778 | A | * | 6/1978 | Wing | 269/71 |

(Continued)

FOREIGN PATENT DOCUMENTS

| | | |
|---|---|---|
| DE | 70 14 580 | 8/1972 |

(Continued)

*Primary Examiner* — Darnell Jayne
*Assistant Examiner* — Joshua Rodden
(74) *Attorney, Agent, or Firm* — Paul Vincent

(57) ABSTRACT

A prop head (17) of a formwork prop for a concrete ceiling has an end piece (15) facing the concrete ceiling, the end piece (15) having a longitudinal axis which extends substantially perpendicular to the plane of the concrete formwork. The prop head (17) also has a hinge mechanism (20) at the end piece (15) end facing away from the concrete ceiling. The longitudinal axis of the end piece (15) can be placed in swiveled positions relative to the longitudinal axis of the prop in hinged positions of the hinge mechanism (20), the hinged positions being lockable by means of fastening means (30), preferably on the hinge mechanism (20). A load-introducing center of gravity formed by the end piece (15) end facing the concrete ceiling essentially lies on a line encompassing the longitudinal axis (62) of the prop (2, 3, 4) in the hinged positions.

10 Claims, 3 Drawing Sheets

U.S. PATENT DOCUMENTS

| | | | | |
|---|---|---|---|---|
| 4,147,321 | A * | 4/1979 | Gostling | 248/354.1 |
| 4,880,203 | A * | 11/1989 | Holcomb et al. | 249/24 |
| 4,884,791 | A | 12/1989 | Callender | |
| 5,085,398 | A * | 2/1992 | Holcomb et al. | 249/24 |
| 5,614,122 | A * | 3/1997 | Schworer | 249/210 |
| 5,643,487 | A * | 7/1997 | Malone | 249/18 |
| 6,705,809 | B2 * | 3/2004 | Manos, Jr. | 408/89 |
| 6,871,454 | B2 * | 3/2005 | Coday et al. | 52/126.6 |
| 2004/0075042 | A1 * | 4/2004 | Arozena Bergaretxe | 249/210 |
| 2004/0075043 | A1 * | 4/2004 | Arozena Bergaretxe | 249/210 |
| 2006/0042179 | A1 * | 3/2006 | Vanagan | 52/633 |
| 2007/0262228 | A1 * | 11/2007 | McCracken | 249/24 |
| 2009/0194665 | A1 * | 8/2009 | Martin | 249/18 |
| 2009/0294627 | A1 * | 12/2009 | Schwoerer | 249/18 |

FOREIGN PATENT DOCUMENTS

| | | | |
|---|---|---|---|
| DE | 29 16 452 | | 7/1980 |
| DE | 76 17 464 | | 12/1981 |
| DE | 3316557 | C1 * | 10/1984 |
| DE | 254 045 | | 2/1988 |
| DE | 4204773 | A1 * | 8/1993 |
| DE | 100 56 831 | | 2/2002 |
| EP | 0 283 391 | | 9/1988 |
| GB | 1 364 979 | | 8/1974 |
| GB | 2029483 | A * | 3/1980 |
| GB | 2265654 | A * | 10/1993 |
| JP | 06 240 865 | | 8/1994 |
| JP | 6240865 | A * | 8/1994 |

* cited by examiner

PROP HEAD FOR CEILING FORMWORK

This application is the national stage of PCT/DE2007/002066 filed on Nov. 15, 2007 and also claims Paris Convention priority to DE 10 2006 055 306.3 filed on Nov. 23, 2006.

BACKGROUND OF THE INVENTION

The invention concerns a head for a prop of formwork for a concrete ceiling, having an end piece facing the concrete ceiling and of which the longitudinal axis extends perpendicular to the plane of the concrete formwork, and a prop of a concrete formwork, and a concrete formwork with such a prop head. The prop head in accordance with the invention is in particular suitable for use in formwork for slanted concrete ceilings, i.e. for concrete ceilings which have a vertical component of direction.

Formwork for concrete-cast ceilings (ceiling formwork) usually comprises a system of steel or wood girders, for example, onto which the formwork panels which shape the bottom side of the concrete ceiling are placed. This is referred to as grid formwork. Alternatively, the formwork panels may be fixed to a rigid substructure, mostly consisting of aluminum girders. Such a substructure, having at least one formwork panel fixed to it, is referred to as a panel. The ends of the girders and/or the panel are fixed to prop heads which extend the props of the concrete formwork axially towards the concrete ceiling. The girders of the concrete ceiling formwork have clasping mechanisms disposed at their ends by means of which they are often clasped by clasping structures (receivers) shaped to complement the clasping mechanisms in the region of the end piece end of the prop head facing the concrete ceiling, which allows swift mounting of the ceiling formwork. In ceiling formwork, the girders are always aligned perpendicular to the longitudinal axis of the prop head, since the clasping structures are configured in such a way that the girders are aligned perpendicular to the prop head. The girders of the concrete formwork can only absorb the vertical forces caused by the loads they support, since they can divert forces substantially only in their axial direction.

Prop heads which are configured as so-called drop-heads are known to also facilitate dismounting of such ceiling formwork. In such drop-heads, the clasping structures of the drop-head are configured on elements which move axially in the longitudinal direction of the prop and/or the drop-head, wherein the elements can be secured by means of wedges and/or wedge plates, for example, and which hold the completely mounted ceiling formwork ready for concrete-casting. Once the concrete ceiling has sufficiently hardened, the wedge and/or wedge plate, for example, can be knocked out and/or released, whereupon the mobile element can be shifted away from the concrete ceiling or falls down on its own by gravity. In this dismantled position, the girders can easily be dismounted. Such drop-heads and associated concrete formwork are disclosed, for example, in U.S. Pat. Nos. 3,915,423 and 3,239,188.

In case of slanted ceiling formwork, i.e. formwork for a slanted concrete ceiling, the girders of the concrete formwork and the formwork panels disposed on them do not extend exclusively horizontally. Nevertheless, the girders are disposed perpendicular to the longitudinal axis of the prop heads in known slanted ceiling formwork. The props are therefore placed upon a floor plate, for example, slanted relative to the vertical at an angle which tallies with the incline of the ceiling to be concrete-cast. As the downward forces produced by the ceiling formwork and the concrete ceiling would cause the girders of the ceiling formwork to collapse, these downward forces are captured by means of bracing means, for example chains, which are fixed to the floor and the ceiling formwork. The stability of the props is thus secured by a bracing system. This bracing system must be applied with precision to ensure the stability of the ceiling formwork. Furthermore, the bracing system considerably affects the accessibility of the room below the ceiling to be concrete-cast. Therefore, the effort required to concrete slanted ceilings is considerably higher than in merely horizontal ceilings.

DD 254 045 A1 discloses a prop head of the inventive kind. This prop head has a hinge mechanism disposed at the end facing away from the concrete ceiling via which it is connected with a prop. When used in formwork for a slanted concrete ceiling, the prop head is offset from the prop, i.e. mounted in a hinged position. In this embodiment, the end of the prop head facing the concrete ceiling is positioned at a slant angle next to the longitudinal axis of the prop, creating overturning torques which may render the concrete formwork unstable.

The invention is based on the task of providing a prop head, and a prop, and concrete formwork which avoid the disadvantages of prior art, wherein in particular the structure of formwork for slanted ceilings is rendered more simple.

This task is fulfilled by the prop head, and the prop, and the concrete formwork according to the independent claims. The dependent claims are preferred embodiments of the invention.

SUMMARY OF THE INVENTION

The prop head in accordance with the invention has an end piece which faces the concrete ceiling and of which the longitudinal axis extends substantially perpendicular to the plane of the concrete formwork. Girders of a ceiling formwork are fixed to this end piece, for example by clasping, when the ceiling formwork is mounted, in such a way that the girders are firmly connected with the end piece. The prop head comprises a hinge mechanism at the end piece end facing away from the concrete ceiling. This hinge mechanism is used to position the longitudinal axis of the end piece in hinged positions of the hinge mechanism relative to the longitudinal axis of the prop in swiveled positions. The hinged positions are lockable by means of fastening means, preferably on the hinge mechanism.

This ensures that the props of concrete formwork can be placed perpendicular on the floor, i.e. the surface on which they rest, while maintaining the longitudinal axis of the end piece also in a perpendicular position relative to the plane of the formwork for a slanted concrete ceiling. The hinge angle of each hinged position tallies with the angle of inclination of the slanted concrete ceiling at the point where the respective prop is positioned. Locking the hinged positions allows the entire concrete formwork to be constructed in a rigid manner. Horizontal loads caused by slanted props are thereby avoided. Concrete ceiling formwork with prop heads in accordance with the invention is therefore a substantially rigid body with a slanted surface and corresponding stability. When using prop heads in accordance with the invention to mount formwork for slanted ceilings, the mounting process does not require considerably more effort than mounting formwork for exclusively horizontal concrete ceilings, since only the hinge angle of the prop heads must be adjusted in accordance with the incline of the concrete ceiling, and no additional bracing of the ceiling formwork is required to stabilize it.

According to the invention, a load-introducing center of gravity formed by the end piece end facing the concrete ceiling essentially lies on a straight line encompassing the longitudinal axis of the prop in the hinged positions.

A load-introducing center of gravity or central point formed by the end piece end facing the concrete ceiling therefore essentially lies on a line encompassing the longitudinal axis of the prop in the hinged positions. The load introductions and/or load-introducing areas in this case are the regions at the prop head where the weight which comes from the ceiling of the formwork to be concrete-cast itself is applied to the prop head, i.e. at the point where girders of the ceiling formwork are and/or will be fixed to the prop head and/or at a center of gravity where the girders are and/or will be fixed to the prop head.

This feature of the prop head causes the forces occurring to act vertically on the props to which the prop heads in accordance with the invention are mounted and/or fixed. There are no substantial overturning torques.

In a particularly preferred embodiment, the hinge mechanism has a skid forming a segment of a circle and a profile element which guides the skid. The profile element can be shifted as if on a rail and/or the skid can be moved accordingly in the profile element. In equal loads, the load-introducing center of gravity is between the two load-introducing points. This load-introducing center of gravity is preferably the center of a circle which is defined by the segment of a circle formed by the skid. If the center of the circle is on the prop axis, no off-center loads are introduced in the prop in any hinged position.

The skid is advantageously configured at the end piece end facing away from the concrete ceiling and the profile element structured and disposed to be mounted to the end of the prop facing the prop head, for example by means of screw holes, or fixed to the end of the prop facing the prop head, for example by welding. This embodiment is more stable than an embodiment where the profile element is configured at the end piece end facing away from the concrete ceiling, since the skid may thus be fixed to the end piece with its inner surface. In the reverse case, the skid would have to be fixed with its outer surface.

In a preferred embodiment, the cross-section of the skid is pi-shaped and/or the profile element has at least one C-shaped guiding groove. The roof of the pi is formed by the skid itself, while the two legs serve to stiffen the fastening of the skid, in particular at the end piece of the prop head. If the profile element has at least one C-shaped guiding groove, the skid can be shifted in these guiding grooves with precision, since the C-shape is complementary to the segment-of-a-circle shape of the skid.

If the skid is distant in an asymmetrical manner from the longitudinal axis of the end piece facing the concrete ceiling, the space required by the prop head in accordance with the invention can be reduced while the maximum hinge angle remains the same. The more distant part of the skid is then locked in the profile element in a maximum hinged position. Such saving in space helps further improve the accessibility of the room below the ceiling formwork.

In a preferred embodiment, the fastening means comprise screws, wherein the screws can be used to shape the profile element in such a way that the skid is clamped in the profile element. Clamping by means of screws enables simple and very stable fixation of the skid in the profile element in the hinged positions.

In an advantageous embodiment, a scale for indicating hinge angles between the longitudinal axis of the end piece and the longitudinal axis of the prop in the hinged positions is provided. This ensures that the prop heads in accordance with the invention can be slightly preset before mounting the ceiling formwork. The scale can, for example, be configured at the inner surface of the skid or at its outer edge.

If the prop head is configured as a drop-head, dismounting of the ceiling formwork with prop heads in accordance with the invention is also rendered considerably easier.

For further improvement of stability, the prop head in accordance with the invention may have at least one eyelet for fastening bracing means to secure the concrete formwork.

A prop of formwork for a concrete ceiling in accordance with the invention has a prop head in accordance with the invention at the end facing the concrete ceiling formwork.

In a prop in accordance with the invention, the screws of the fastening means for the prop head are preferably guided through screw holes at an end plate at the end of the prop near to the prop head, which ensures that the prop head is fixed to the end plate without additional screwing being required.

A concrete formwork system with formwork for a concrete ceiling in accordance with the invention comprises at least one prop in accordance with the invention.

In such a concrete formwork system, girders of the concrete ceiling formwork, i.e. girders of panels or grid formwork, for example, are clasped by clasping structures disposed at the ends of the girders which are shaped to complement the clasping mechanisms in the region of the end piece end of the prop head facing the concrete ceiling. This structure is the known structure of formwork for a concrete ceiling, wherein conventional prop heads are simply replaced with prop heads in accordance with the invention. This means that many existing parts can be used to mount such a concrete formwork system.

An embodiment of the invention will be described in more detail below by reference to the figures of the drawing.

DESCRIPTION OF THE PREFERRED EMBODIMENT

The figures of the drawings show a strongly schematic representation of the object in accordance with the invention and must not be understood as being true to scale. The individual components of the object in accordance with the invention are shown in a manner which allows good representation of their structure.

Figure 1A:
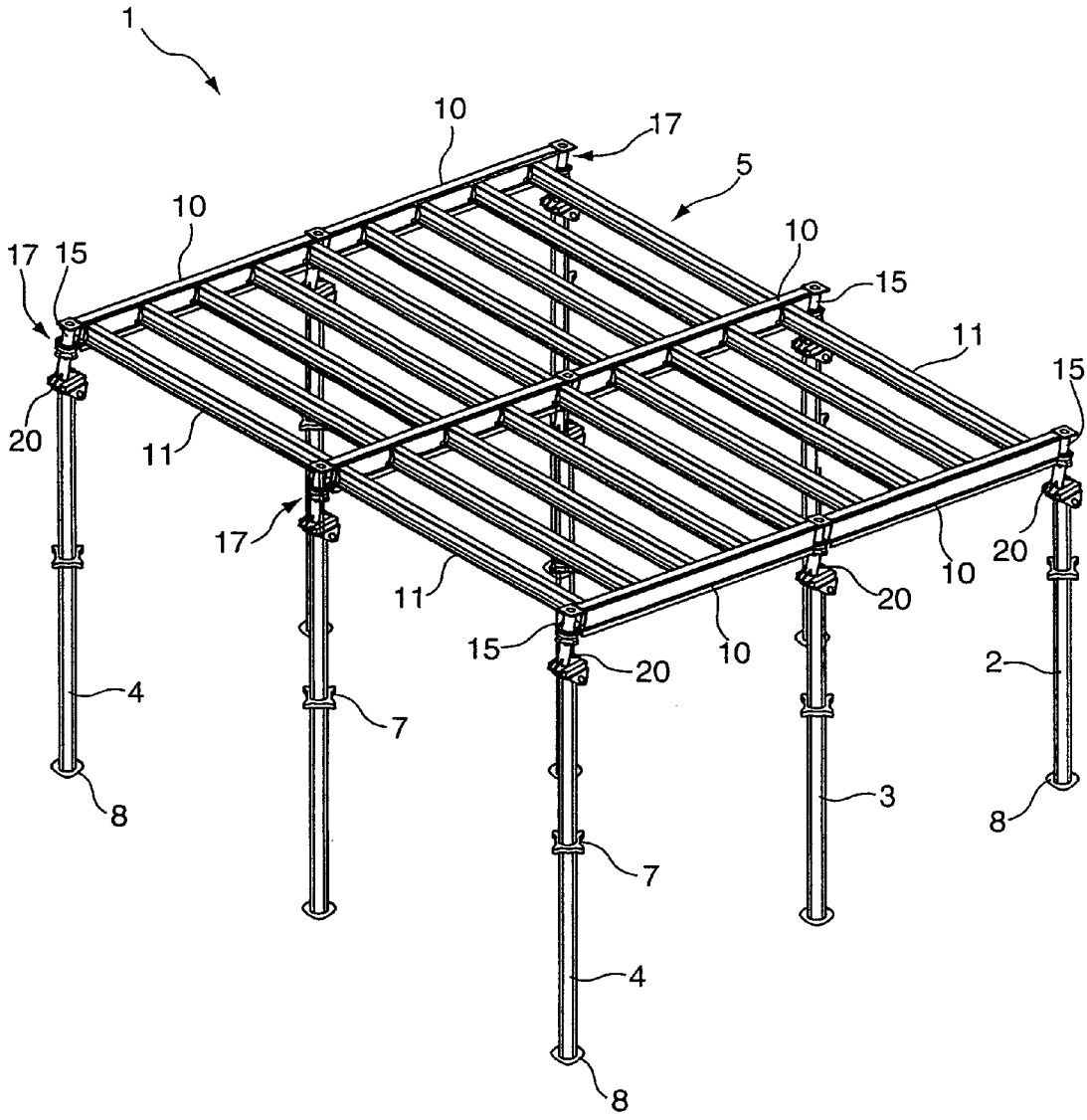
FIG. 1*a* shows a perspective view of formwork for a slanted concrete ceiling in accordance with the invention.
Figure 1B:
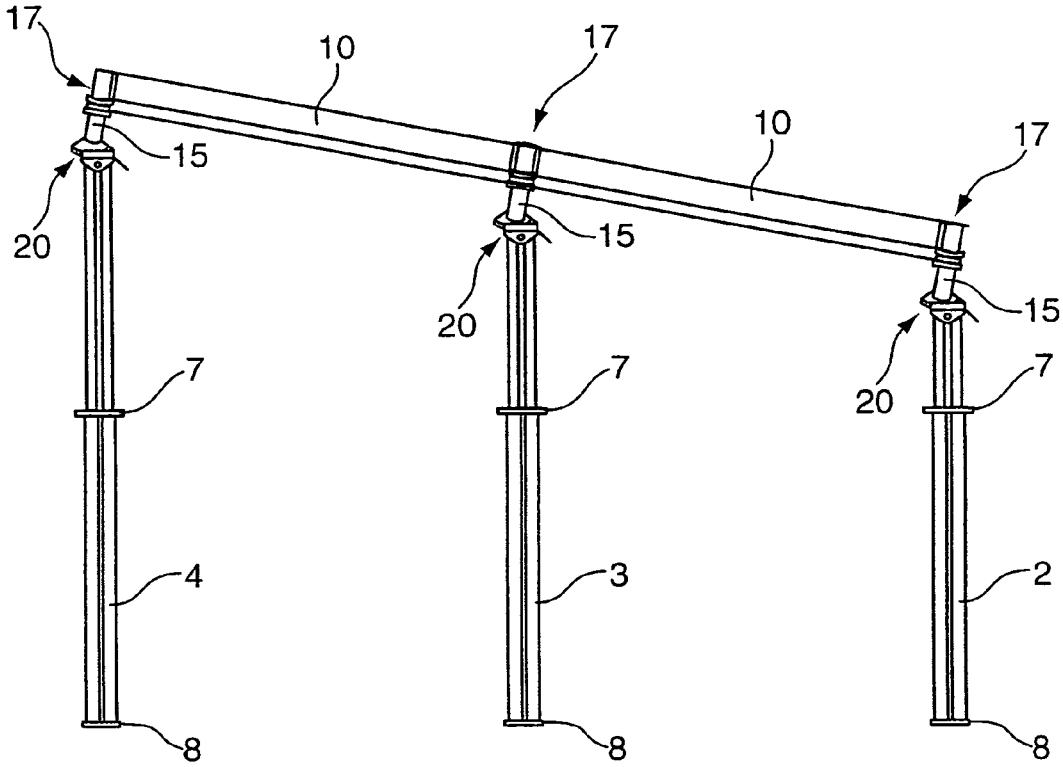
FIG. 1*b* shows a side view of the formwork for a concrete ceiling as shown in FIG. 1*a*.

FIG. 1*a* shows a perspective view of formwork for a slanted concrete ceiling 1 in accordance with the invention, wherein the formwork for a concrete ceiling 1 has a grid formwork system 5 which rests on nine props 2,3,4. The formwork panels to be placed on the grid formwork system 5 to shape the surface of the ceiling to be concrete-cast are not shown in the figure. The ceiling to be concrete-cast is slanted at the back right in the embodiment shown in this figure. The props 2 located at the back in this figure are therefore shorter than the props 4 located at the front in this figure. FIG. 1*b* shows a side view of formwork for a concrete ceiling 1 as shown in FIG. 1*a*, wherein the different heights of the props 2,3,4 are well apparent. Each of the props 2,3,4 has height adjustment means 7, which are standard in such construction props, to adjust the length of the props 2,3,4 and thus the height of the concrete ceiling relative to the floor, i.e. the surface on which the props 2,3,4 rest, desired at the respective prop. In addition, a prop foot 8 is provided at the end of each of the props 2,3,4 facing away from the concrete ceiling, which may, for example, be disposed as a base plate with bores. The grid system 5 has longitudinal girders 10 and transverse girders 11, wherein the ends of the transverse girders 11 are fixed to the longitudinal girders 10. Each of the ends of the longitudinal girders 10 is fixed in such a way to the end piece 15 end of a prop head 17 in accordance with the invention, disposed as a drop-head, facing the concrete ceiling that the longitudinal girders 10 rest perpendicular on the longitudinal axis of the respective end piece 15. The end pieces 15 of the prop heads 17 are therefore swiveled at an angle relative to the longitudinal axes of the props 2,3,4 which tallies with the incline of the ceiling to be concrete-cast. For this purpose, the end piece 15 end of each of the prop heads 17 facing away from the concrete ceiling has a hinge mechanism 20 by means of which the longitudinal axis of the end piece 15 can be placed in swiveled positions relative to the longitudinal axis of the prop onto which the respective prop head 17 is mounted in hinged positions of the hinge mechanism 20.

Figure 2:
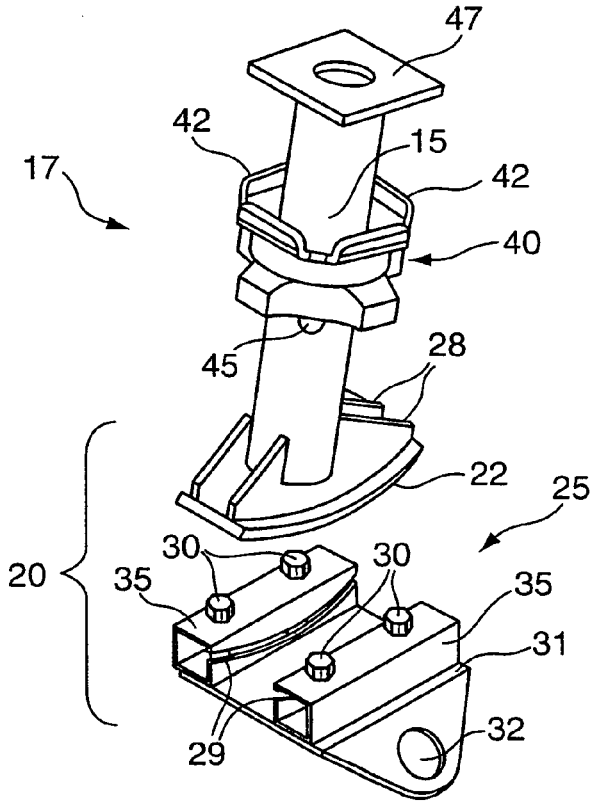
FIG. 2 shows a prop head in accordance with the invention configured as a drop-head.

FIG. 2 shows a prop head 17 in accordance with the invention disposed as a drop-head as positioned between the longitudinal girders of formwork for a concrete ceiling as shown in FIG. 1. The hinge mechanism 20 of the prop head 17 is shown in a dismounted state in this representation. The hinge mechanism 20 has a skid 22 forming a segment of a circle and a profile element 25 in which the skid 22 is guided in a mounted state. The skid 22 is configured at the end piece 15 end, essentially made of a steel tube, facing away from the concrete ceiling, and the profile element 25 is structured and disposed to be mounted to the end of a prop, for example as shown in FIG. 1. For this purpose, the profile element 25 may, for example, be screwed to a screw hole plate of the prop. The cross-section of the skid 22 is pi-shaped, wherein the roof of the pi is formed by the skid itself and the two legs 28 of the pi serve to stiffen and fix the skid 22 to the end piece 15 of the prop head 17, for example by welding. The profile element 25 has two C-shaped guiding grooves 29 to guide the skid 22 in the profile element 25. The skid 22 can be swiveled into the hinged positions with precision in these guiding grooves 29. Thereby, the longitudinal axis of the end piece 15 can be positioned relative to the longitudinal axis of a prop in various hinged positions, i.e. at various angles which tally with different ceiling inclines. Screws 30 are mounted to the thus configured hinge mechanism 20 which, due to the fact that the profile element can be shaped by tightening the screws 30 in such a way that the skid 22 is clamped in the profile element 25 in the mounted state, form fastening means by means of which the hinged positions are lockable. Nuts into which the screws 30 can be screwed may, for example, be disposed on the profile element 25 or threads may be cut into a base plate 31 of the profile element 25 into which the screws are screwed 30. As is apparent in the figure, the skid 22 is distant in an asymmetrical manner from the longitudinal axis of the end piece 15 facing the concrete ceiling. In the perspective view, the skid 22 is pulled out more to the right than it protrudes to the left. Furthermore, the prop head 17 has an eyelet 32 for fastening bracing means to secure the concrete formwork. The eyelet 32 is formed by a hole in a base plate 31 of the profile element 25 of the prop head 17 onto which two squared structural tubing shapes 35, into each of which one of the C-shaped guiding grooves 29 is cut, are fixed to form the profile element 25. In the region of the end piece 15 end of the prop head 17 facing the concrete ceiling, the prop head 17 has an element 40 (rotating wedge) forming a ring which can be shifted in the longitudinal direction of the prop head 17, and an element (not rotating) resting on top of this which can be shifted axially, having clasping structures 42 for fixing clasping mechanisms of girders of concrete formwork, for example to the longitudinal girders as shown in FIG. 1. This shiftable element 40 (rotating wedge) moves the clasping structures 42 in a formwork position and secures this position. The end of the girder at which the clasping mechanisms are disposed is then firmly positioned between the clasping structures 42 and the end plate 47 of the end piece 15 shown. Since the clasping structures 42 automatically descend when the rotating wedge or shiftable element 40 is released, this position allows removing of the main girder 10. Such embodiments of a prop head 17 are referred to as drop-heads.

Figure 3A:
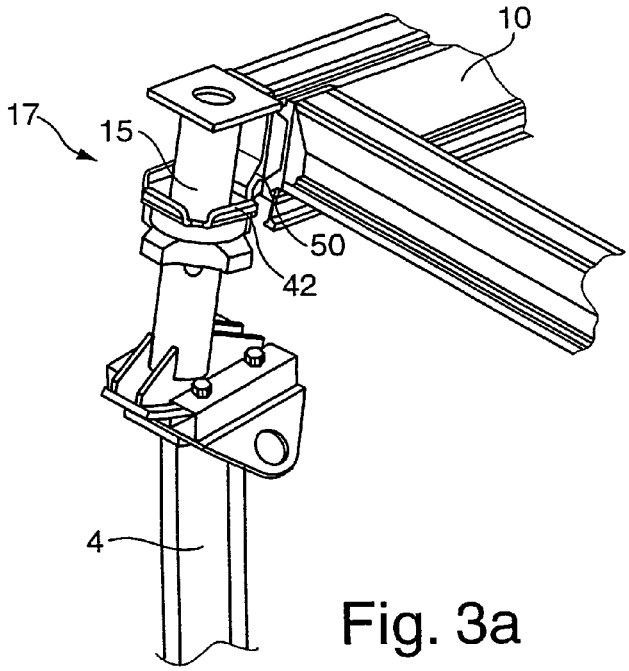
FIG. 3*a* shows an enlarged view of the formwork for a concrete ceiling as shown in FIG. 1*a*.
Figure 3B:
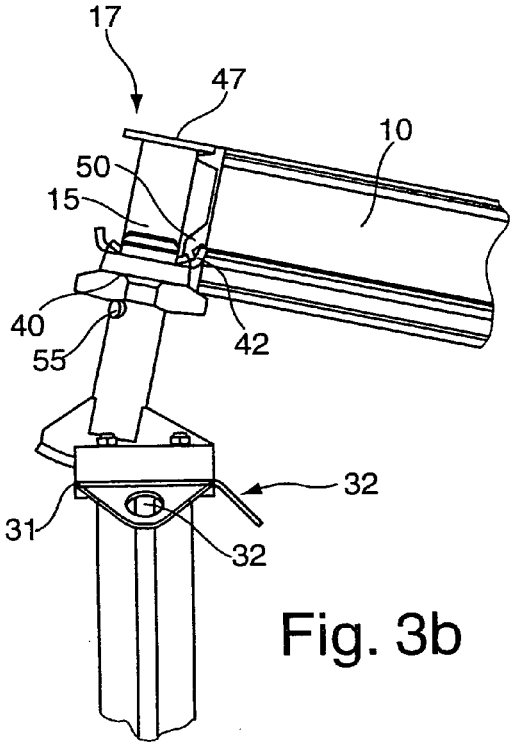
FIG. 3*b* shows an enlarged view of a side view of the left end of formwork for a concrete ceiling as shown in FIG. 1*b*.
Figure 3C:
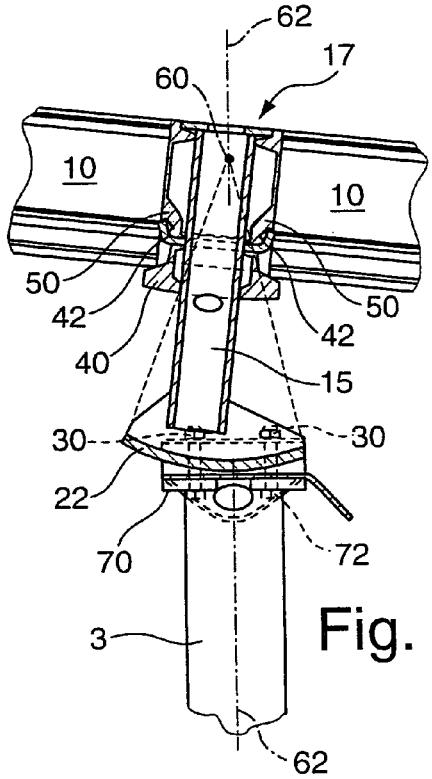
FIG. 3*c* shows a cross-section of the region around a prop head 17 as shown in FIGS. 1*a* and 1*b*.

FIGS. 3*a* to 3*c* each show one prop head 17 in accordance with the invention as shown in FIG. 2 in a state where they are, for example, installed in formwork for a concrete ceiling as shown in FIG. 1. FIG. 3*a* shows an enlarged view of the top left corner of formwork for a concrete ceiling as shown in FIG. 1*a*. It is well apparent how the longitudinal axis of the end piece 15 is in a swiveled position relative to the longitudinal axis of the prop 4. It is further well apparent in this representation how clasping mechanisms 50 disposed at the end of the longitudinal girder 10 are clasped by the clasping structures 42, formed to complement them, in the region of the end piece 15 end of the prop head 17 facing the concrete ceiling.

FIG. 3*b* shows an enlarged view of a side view of the left end of formwork for a concrete ceiling as shown in FIG. 1*b*. It is particularly well apparent here how the end of the main girder 10 at which the clasping mechanisms 50 are disposed is firmly positioned between the clasping structures 42 disposed on the shiftable element 40 of the drop-head and the end plate 47 of the end piece 15 of the drop-head shown in the mounted position of the prop head 17 disposed as a drop-head. The shiftable element 40 (rotating wedge) is secured in the mounted position shown by means of a stationary bolt 55. The prop head 17 shown has two eyelets 32 for fastening bracing means to secure the concrete formwork, each of which is disposed as a hole in the fishplates formed by the base plate 31 of the prop head 17. One of the fishplates is shown in a side view, wherein the hole which forms the eyelet cannot be seen.

FIG. 3*c* shows a cross-section of the region around a prop head 17 as shown in FIG. 1, wherein the clasping structures 50 of two longitudinal girders 10 are clasped by the clasping mechanisms 42 of the prop head 17, which are disposed symmetrically on the shiftable element 40 of the prop head 17 disposed as a drop-head. As indicated by the dashed lines, the skid 22 forms a segment of a circle whose center 60 is located in the area of the prop head 17. Thereby, load-introducing areas for the weight of the concrete ceiling and/or the ceiling formwork formed by the end piece 15 end facing the concrete ceiling extend substantially along a line (prop axis) encompassing the longitudinal axis 62 of the prop 3 in the hinged positions of the prop head 17. The longitudinal axis of the end piece 15 is thus inclined in such a way relative to the longitudinal axis of the prop 3 that the load, i.e. the weight resting on it, is introduced centrally into the prop. Consequently, only centrical forces are applied to the prop, i.e. there is neither a torque, nor is the prop laterally displaced. The load therefore acts directly above the longitudinal axis of the prop regardless of the incline of the ceiling to be concrete-cast.

The screws 30 of the fastening means are guided through screw holes at an end plate 70 of the prop 3 at the end of the prop 3 which is near to the prop head. Thereby, the same screws 30 by tightening of which the profile element in which the skid 22 is guided is shaped, i.e. compressed, to lock the hinged positions fix the prop head 17 to the end plate 70. In the embodiment shown, the screws 30 are screwed into nuts 72 below the end plate 70.

Proposed is a prop head 17 for a prop of formwork for a concrete ceiling, having an end piece 15 which faces the concrete ceiling and of which the longitudinal axis extends substantially perpendicular to the plane of the concrete formwork. The prop head 17 has a hinge mechanism 20 at the end piece 15 end facing away from the concrete ceiling, wherein the longitudinal axis of the end piece 15 can be placed in swiveled positions relative to the longitudinal axis of the prop in hinged positions of the hinge mechanism 20, and wherein the hinged positions are lockable by means of fastening means 30, preferably on the hinge mechanism 20.

A load-introducing center of gravity formed by the end piece 15 end facing the concrete ceiling essentially lies on a line encompassing the longitudinal axis 62 of the prop 2,3,4 in the hinged positions.

The invention is not limited to the above-mentioned embodiments. Rather, a number of variants is conceivable which uses the features of the invention even if the embodiments are of a fundamentally different kind.

I claim:

1. A prop head for a concrete ceiling, a concrete ceiling formwork and a concrete ceiling formwork prop, the formwork prop having a longitudinal axis, the prop head comprising:

an end piece having a first end structured to face the concrete ceiling and a second end structured to face the formwork prop, said end piece having a longitudinal axis extending in an elongated direction of said end piece, wherein, in a position of use of the prop head, said longitudinal axis extends substantially vertically and perpendicular to a plane of the concrete ceiling formwork;

a skid forming a segment of a circle, said skid being integral with said second end of said end piece, wherein a center of a circle defined by said segment of said circle of said skid is disposed proximate to said first end of said end piece;

a profile element in which said skid is guided, said profile element structured and disposed for cooperation with an end of the formwork prop facing said second end of said end piece, wherein said profile element and said skid define a hinge mechanism, said longitudinal axis of said end piece thereby pivoting together with said skid relative to the longitudinal axis of the formwork prop into hinged positions of said hinge mechanism, wherein a load-introducing center of gravity formed by said first end of said end piece in said hinged positions essentially lies on a line encompassing the longitudinal axis of the formwork prop; and fastening means cooperating with said hinge mechanism to lock said hinge mechanism in said hinged positions, said fastening means having screws disposed, structured and dimensioned to load and firmly clamp said skid within said profile element.

2. The prop head of claim 1, wherein said load-introducing center of gravity corresponds to said center of said circle defined by said segment of said circle of said skid.

3. The prop head of claim 1, wherein a cross-section of said skid is pi-shaped and/or said profile element has at least one C-shaped guiding groove.

4. The prop head of claim 1, wherein said skid is spaced apart in an asymmetrical manner from said longitudinal axis of said end piece.

5. The prop head of claim 1, further comprising a scale for indicating hinge angles of said longitudinal axis of said end piece relative to the longitudinal axis of the formwork prop in said hinged positions.

6. The prop head of claim 1, wherein the prop head is a drop-head.

7. The prop head of claim 1, wherein the prop head defines an eyelet for fastening bracing means to secure the concrete formwork.

8. A prop formwork for a concrete ceiling having the prop head of claim 1, wherein the prop head has an eyelet for fastening bracing means to secure a concrete formwork, the prop formwork further comprising a formwork prop and said screws guided through screw holes in an end plate of the formwork prop proximate the prop head, wherein the prop head is fixed to said end plate.

9. A concrete formwork comprising a formwork for a concrete ceiling and the prop formwork of claim 8.

10. The concrete formwork of claim 9, further comprising clasping mechanisms disposed at an end of girders of the formwork for a concrete ceiling clasped by clasping structures formed to complement said clasping mechanisms in an area of said first end of said end piece of the prop head.

* * * * *